United States Patent [19]

Honegger et al.

[11] Patent Number: 4,684,117

[45] Date of Patent: Aug. 4, 1987

[54] METHOD AND APPARATUS FOR OPENING PRINTED PRODUCTS WHICH HAVE BEEN FOLDED OFF-CENTER

[75] Inventors: Werner Honegger, Tann-Rüti; Egon Hänsch, Wetzikon, both of Switzerland

[73] Assignee: Ferag AG, Hinwil, Switzerland

[21] Appl. No.: 877,360

[22] Filed: Jun. 23, 1986

[30] Foreign Application Priority Data

Jul. 1, 1985 [CH] Switzerland ..... 2828/85
Jul. 26, 1985 [CH] Switzerland ..... 3245/85

[51] Int. Cl.[4] ..... B65H 39/02

[52] U.S. Cl. ..... 270/54; 270/55; 270/58; 271/202; 271/270; 271/271; 198/424

[58] Field of Search ..... 270/53–58; 271/202, 204, 270, 206, 271, 277, 9, 69, 182; 198/644, 424, 423, 803.7–803.11

[56] References Cited

U.S. PATENT DOCUMENTS

| | | | |
|---|---|---|---|
| 2,969,981 | 1/1961 | Faeber | 270/54 |
| 3,481,594 | 12/1983 | McCain et al. | 270/54 |
| 4,007,824 | 2/1977 | Reist | 198/423 |
| 4,126,390 | 11/1978 | Connin | 271/204 |
| 4,201,286 | 5/1980 | Meier | 271/206 X |
| 4,205,837 | 6/1980 | von Hein et al. | 271/270 |
| 4,320,894 | 3/1982 | Reist et al. | 271/277 |
| 4,555,101 | 11/1985 | Stobb | 271/277 |
| 4,641,825 | 2/1987 | Mowry | 270/53 |

FOREIGN PATENT DOCUMENTS

| | | |
|---|---|---|
| 0095603 | 12/1969 | European Pat. Off. . |
| 512870 | 10/1939 | United Kingdom . |

*Primary Examiner*—E. H. Eickholt
*Attorney, Agent, or Firm*—Werner W. Kleeman

[57] ABSTRACT

Printed products to be opened are held at their folded or spine edge and, with their open or fan edge located opposite to this folded edge, are fed forward with their fan edge leading into an opening or spreading device or apparatus. A lower portion of the printed products possesses a leading edge section or marginal lap section due to an off-center fold. Circulatingly driven grippers or clamps grip this lower portion of the printed products in the region of the leading edge section and guide it along a downwardly and backwardly curved path. The printed products are simultaneously further transported or conveyed by means of feeders or feeding devices. Both portions of each printed product (i.e. the upper and the lower portions) are thus separated from one another. A collating conveyor of a collating drum or cylinder can be inserted into the opening thus formed between both product portions. Such a collating drum or cylinder may possess a plurality of circulatingly driven collating conveyors.

24 Claims, 9 Drawing Figures

METHOD AND APPARATUS FOR OPENING PRINTED PRODUCTS WHICH HAVE BEEN FOLDED OFF-CENTER

CROSS REFERENCE TO RELATED APPLICATION

The present application is related to the commonly assigned, copending U.S. patent application Ser. No. 06/877,359, filed June 23, 1986, and entitled "METHOD AND APPARATUS FOR COLLATING FOLDED PRINTED PRODUCTS, ESPECIALLY SIGNATURES OR SHEETS" , the disclosure of which is incorporated herein by reference.

CROSS REFERENCE TO RELATED CASE

This application is also related to the commonly assigned, copending U.S. application Ser. No. 06/899,221, filed July 25, 1986 and entitled "APPARATUS FOR COLLATING FOLDED PRINTED PRODUCTS, ESPECIALLY SIGNATURES OR SHEETS", the disclosure of which is incorporated herein by reference.

BACKGROUND OF THE INVENTION

The present invention broadly relates to a new and improved method and apparatus for opening printed products which have been folded off-center.

Generally speaking, the present invention relates to a new and improved method for opening printed products which have been folded off-center or asymmetrically. One portion of such printed products, namely the open or fan edge opposite to the folded or spine edge, possesses a leading edge or marginal lap section. That is to say, one lap or edge of this open or fan edge protrudes or projects marginally beyond the other lap or edge. The printed products are gripped at their folded edge and conveyed in a direction which is transverse to the folded edge. One portion of the printed products is temporarily gripped in the region of the aforesaid open edge during product conveyance for separating or opening both portions of the printed products.

In other words, the method of the present invention is for opening asymmetrically or off-center folded printed products and comprises the steps of holding each printed product of the asymmetrically folded printed products at a folded edge thereof, each printed product possessing a leading marginal lap on an open edge thereof which is located opposite the folded edge.

The present invention also relates to a new and improved construction of an apparatus for opening printed products which have been folded off-center or asymmetrically. One portion of these printed products, namely the open or fan edge opposite to the folded or spine edge, possesses a leading edge or marginal lap section. That is to say one lap or edge of this open side edge protrudes or projects marginally beyond the other lap or edge. A conveyor is provided having clamps or grippers which are mutually separated or spaced by a predetermined distance or spacing and which are provided for holding the printed products at their folded edge. A product opening or spreading device or apparatus is furthermore provided and is located below the conveyor. This opening device or apparatus possesses circulatingly or revolvingly driven, controllable gripping elements or grippers for temporarily gripping one of the portions of the conveyed printed products in the region of the aforesaid open edge.

In other words, the apparatus of the present invention is for opening asymmetrically folded printed products and comprises at least one feeder or feeder device. The asymmetrically folded printed products each possess a leading marginal lap on an open edge thereof which is located opposite a folded edge thereof.

Furthermore, the present invention also relates to a new and improved construction of an installation for collating printed products which have been folded off-center or asymmetrically and comprising a plurality of the aforesaid opening or spreading devices or apparatuses positioned or located substantially in succession in the product direction of conveyance of the collating apparatus.

In other words, the collating installation of the present invention is for collating asymmetrically or off-center folded printed products and possesses at least two opening apparatuses or devices arranged in succession in a predetermined direction of conveyance of the printed products.

An example of a prior art apparatus of this type is disclosed in the European Patent Application No. 0,095,603, published Dec. 7, 1983, which is cognate to the U.S. Pat. No. 4,489,930, granted Dec. 25, 1984. In this prior art apparatus, the printed products which have been folded off-center and which are to be opened are conveyed such that their folded edges precede or lead and take on a backwardly falling slanted or oblique position. The printed products are grasped at their folded edges by means of grippers of a conveyor. These grippers project backwardly with respect to the direction of conveyance. An opening or spreading device positioned below the conveyor is equipped with circulatingly driven, controllable clamps or grippers. These clamps serve for temporarily holding the leading edge section (termed marginal lap) on the uppermost portion of the advancing printed products. An acceleration belt or strap is positioned subsequent to the circulation track for the clamps. This acceleration belt is circulatingly driven at a higher speed than the clamps. As soon as the lowermost portion of the printed products, which is not held by means of the clamps, is displaced or conveyed into the effective region of this acceleration belt, this lowermost portion of the printed product is entrained as a result of the frictional contact made with the acceleration belt and is separated from the uppermost portion, which is held by means of the clamp. The printed products which are opened in this manner are then dropped or released onto circulating support bars or arms of the collating apparatus upon which the printed products come to rest in a straddled position.

This known prior art solution is expensive or laborious to construct since an acceleration belt or strap is necessary in addition to the circulation track for the clamps. The separation of the product halves, i.e. the opening of the printed products, depends on the frictional entrainment of a portion or section of a printed product by means of the acceleration belt. A reliable or positive opening of the printed product is not ensured under all conditions, especially not if both portions or sections of the printed product adhere to one another in a manner which is more tenacious than usual.

SUMMARY OF THE INVENTION

Therefore, with the foregoing in mind, it is a primary object of the present invention to provide a new and improved method and apparatus for opening printed products which have been folded off-center and which do not exhibit the aforementioned drawbacks and shortcomings of the prior art constructions.

Another and more specific object of the present invention aims at providing a new and improved method and apparatus of the previously mentioned type for opening printed products which have been folded off-center or asymmetrically and which in a simple manner permit a reliable opening of the asymmetrically folded printed products.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that the asymmetrically printed products are conveyed with their open or fan edges leading. The gripped or cramped region of a portion or section of each printed product is moved apart or separated from the other portion or section of the printed product in order to open the printed products.

In other words, the method of the present invention is manifested by the features that it comprises the steps of conveying the printed products in a direction transverse to the direction of extent of the folded edges, momentarily gripping a first portion or section of the open edge of each printed product during product conveyance at the region of the open edge for separating the first portion or section from a second portion or section of each printed product, conveying the printed products with the open edges leading section of each printed product away from the second portion section for opening each printed product.

The apparatus of the present invention is manifested by the features that the feeders or feeder devices convey the printed products with their open or fan edges leading into the region of the opening or separating apparatus or devices. The path of motion of the holding members or elements is such that the leading marginal lap of a gripped portion or section of each printed product is moved away from the other portion or section of the printed product.

In other words, the apparatus of the present invention is manifested by the features that each feeder or feeder device comprises clamping elements or grippers arranged in mutual spaced relationship for holding the printed products at the folded edges. An opening device is positioned substantially below the feeder or feeder device Holding members or elements are circulatingly driven in a path of motion by suitable means. The holding elements or members are controlled by suitable means for momentarily gripping a first portion or section of each printed product of the printed products in the region of the open edge. The feeder is arranged for conveying the printed products into the region of the opening device with the open edge of the printed products leading. The path of movement of the holding members is configured such that the gripped region of the first portion or section of each printed product is displaceable away from a second portion or section of the printed product.

The collating installation of the present invention is manifested by the features that it comprises at least one collating conveyor capable of being inserted between initially separated uppermost and lowermost portions or sections of the asymmetrically folded printed products. It also comprises means for opening clamping members or grippers such that the asymmetrically folded printed products are released and come to rest in a straddling manner on the collating conveyor. It also comprises means for transporting the printed products away from the at least one opening device in a direction extending substantially parallel to folded edges of the asymmetrically folded printed products.

The printed products are conveyed with their open or fan edges which are located opposite to the folded or spine edges, leading. These open edges each possess a leading edge which comprises a marginal lap section. That is to say one lap of this open or fan edge protrudes or projects marginally beyond the other lap. This arrangement permits reliable gripping or clamping of a portion or section of the printed product by means of the holding members or elements since the portion of the printed product to be gripped can be brought without difficulty into the effective region of the holding members or elements. The portion of the printed product which is gripped is then conveyed preferably downwardly and backwardly along a curved path away from the other portion of the printed product. At the same time the printed product, and also thus the other portion of the printed product, is further conveyed by means of the conveyor or feeder. In this manner a separation of both portions or sections of the printed product is guaranteed even if these portions or sections should adhere or cling to one another more tenaciously than usual.

The opening apparatus according to the invention is particularly suitable for application in an installation for collating printed products which have been folded off-center or asymmetrically.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
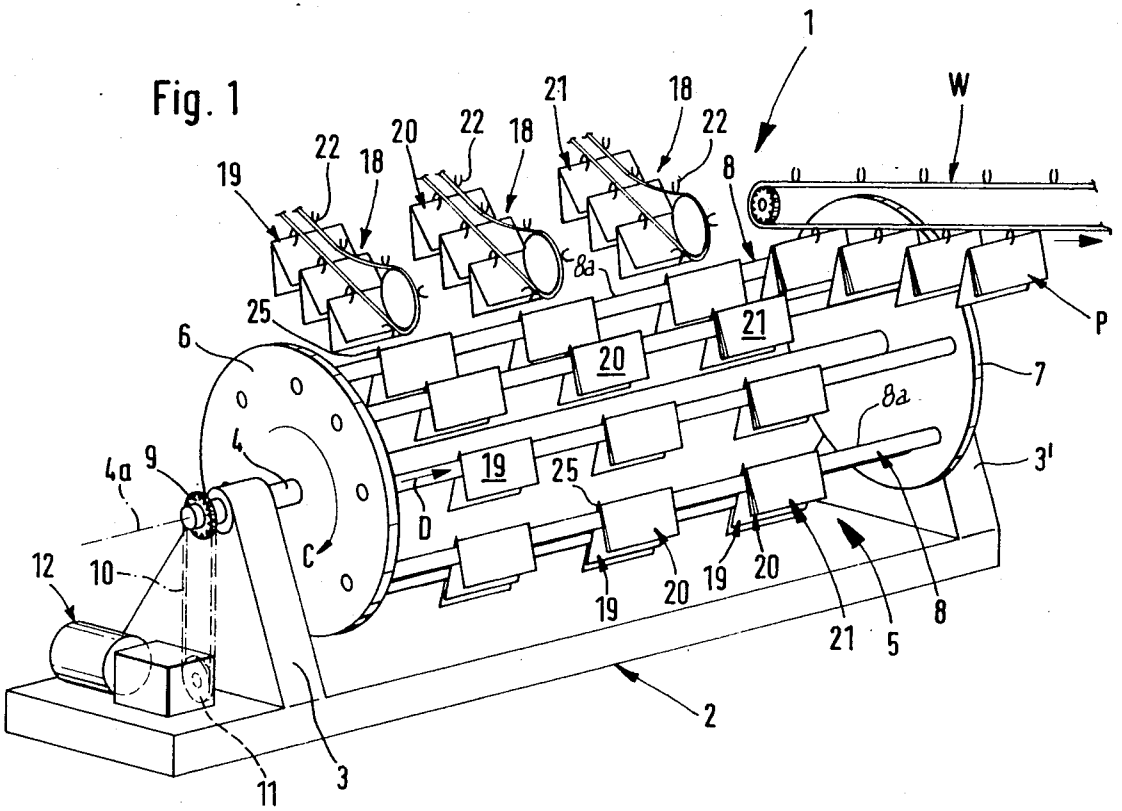
FIG. 1 is a perspective view of a collating installation.
Figure 2:
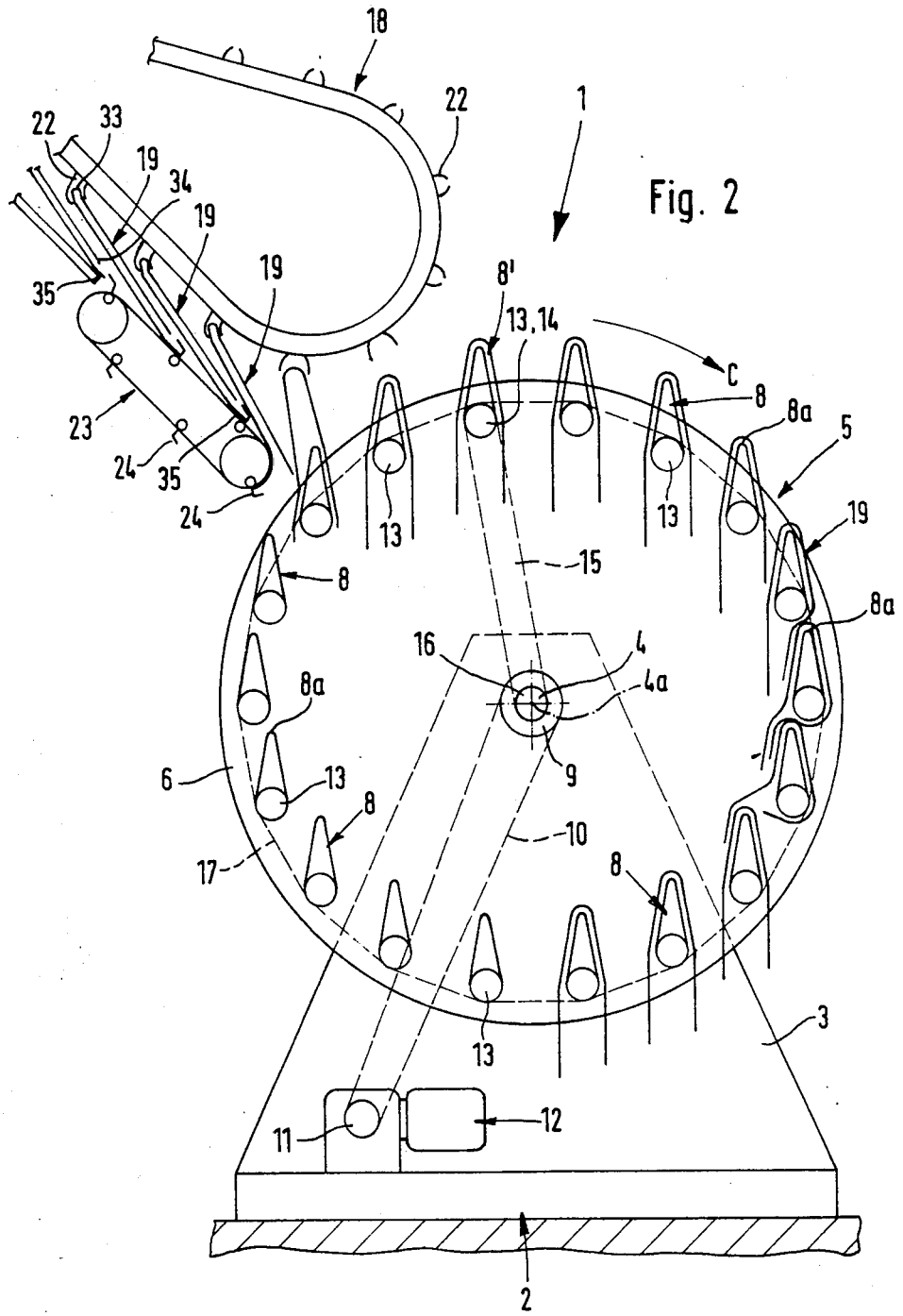
FIG. 2 is an end view on an enlarged scale and in partial section of the collating installation according to FIG. 1.

Describing now the drawings, it is to be understood that to simplify the showing thereof only enough of the structure of the collating installation for opening and collating printed products which have been folded off-center or asymmetrically has been illustrated therein as is needed to enable one skilled in the art to readily understand the underlying principles and concepts of this invention. It should be noted before proceeding that details of the collating apparatus 1 illustrated in FIGS. 1 and 2 forms subject matter of the aforementioned related copending U.S. patent application Ser. No. 06/877,359 and is described in detail in the aforesaid application to which reference may be readily had. Turning now specifically to FIGS. 1 and 2 of the drawings, the collating apparatus 1 illustrated therein by way of example and not limitation, will be seen to comprise a frame or stand 2 with support pedestals or brackets 3 and 3' in which there is mounted a shaft 4 of a collating drum or cylinder 5. Two discoidal rotatable support elements or supports 6 and 7 are attached to the shaft 4 at a predetermined mutual spacing. A plurality of collating devices or collating conveyors 8 are rotatably arranged between these support elements 6 and 7 to rotate about their own axis. That is to say, these collating conveyors 8 are themselves both rotatable within and arranged to revolve with the rotatable support elements 6 and 7. These collating conveyors 8 are arranged substantially parallel to one another and to the shaft 4 of the collating drum or cylinder 5 and positioned in spaced relationship to this shaft 4.

A sprocket or sprocket wheel 9 is positioned on the shaft 4 for guiding a chain 10 which travels over a further sprocket or sprocket wheel 11. The sprocket or sprocket wheel 11 is mounted on a not particularly referenced drive shaft of a drive means 12. The drive means 12 circulatingly or revolvingly drives the collating drum or cylinder 5 including the therein mounted collating conveyors 8 in the direction of the arrow C. The axis of revolution of the collating drum cylinder 5 is designated by reference numeral 4*a*.

As shown in the end view and partial section of the collating apparatus 1 of FIG. 2, the collating conveyors 8 have the shape of a peaked roof. These collating conveyors 8, as stated, are caused to rotate about their longitudinal axes by suitable guide or control transmission means of the drive means 12 during their revolution or orbiting about the common axis of revolution 4*a* of the collating drum or cylinder 5 such that tops or top portions 8*a* of these collating conveyors 8 which are shaped like a saddle or a peaked roof continuously remain in a substantially vertically upright position.

A simplified embodiment of such guide or control transmission means is schematically illustrated in FIG. 2. A sprocket or sprocket wheel 13 is mounted firmly so that it cannot rotate on the collating conveyor 8 at one end of each of the collating conveyors 8. A further equally large sprocket or sprocket wheel 14 is likewise firmly mounted so that it cannot rotate on a collating conveyor 8' of the collating conveyors 8. This sprocket or sprocket wheel 14 engages with a chain 15. The chain 15 is guided or driven by means of a sprocket or sprocket wheel 16 which is stationarily and coaxially attached to the shaft 4 at the support pedestal 3. All sprocket or sprocket wheels 13 engage or mesh with a chain 17 which travels over a portion of the periphery of these sprocket or sprocket wheels 13. By means of this arrangement it is possible for the collating conveyors 8 to maintain their substantially vertical position during their revolution or orbiting about the common axis of revolution 4*a* of the collating drum or cylinder 5.

As can be seen in FIG. 1 when looking in the product direction of conveyance D and parallel to the common axis of rotation 4*a* extending longitudinally of the shaft 4, three feeders or conveyors or feeder devices 18 for the respective folded printed products 19, 20 and 21 are positioned in succession. Subsequent to the last feeder or feeder device 18, as viewed in the direction of conveyance D of the collating conveyors 8, there is positioned an only schematically illustrated conveyor W for removing end products P which each comprise a plurality of overlapping or superimposed folded printed sheets or signatures, that is to say the interstuffed folded printed products 19, 20 and 21.

The foremost of these three identically constructed feeders or conveyors 18 as seen when looking in the direction of conveyance D is illustrated in more detail in FIG. 2. Each of these feeders 18 comprises grippers or clamping members or clamps 22 separated by a mutual spacing or distance. The construction and operation of these grippers or clamps 22 will be further described in relation to FIG. 3.

An opening or separating device 23 is positioned substantially below each feeder 18. This opening device 23 is only schematically illustrated in FIG. 2. The construction of this opening device 23 will be more fully described in relation to the FIGS. 3 to 8. This opening device 23 comprises circulating or revolving holding elements or members 24, such as holding clamps or grippers. These holding clamps or grippers 24 serve to temporarily hold or retain a portion or section of the printed products 19. These holding clamps or grippers 24 will also be further described in more detail.

The printed products 19 which are fed by means of the feeders or feeding devices 18 and opened by means of the opening device 23 are deposited in a straddling manner on the collating conveyors 8. Each collating conveyor 8 is equipped with a here generally indicated conveying device 8*a* which is provided with entrainment means 25 (cf. FIG. 1) and further details of which are more fully described in the aforementioned commonly assigned and copending application. Each conveying device 8*a* displaces or conveys the associated printed products 19, 20 and 21 which rest on or straddle the related conveying device 8*a* in the longitudinal direction of the collating conveyor 8, i.e. in the direction of the arrow D. The drive for the conveyor devices 8*a* is preferably derived from the relative rotational movement between the individual collating conveyors 8 and the support elements 6 and 7. The advance or feed speed of the conveying devices 8*a* is selected such that each entrainment means 25 travels a distance whose length corresponds to the distance or separation between neighboring feeders or feeding devices 18 or their respective opening devices 23 while revolving about the axis 4a of the collating drum or cylinder 5.

Referring now to FIGS. 3 to 9, the construction of the feeders or feeding devices 18 and the opening devices 23, as well as the opening of the delivered printed products 19 will be further described hereinbelow.

Figure 3:
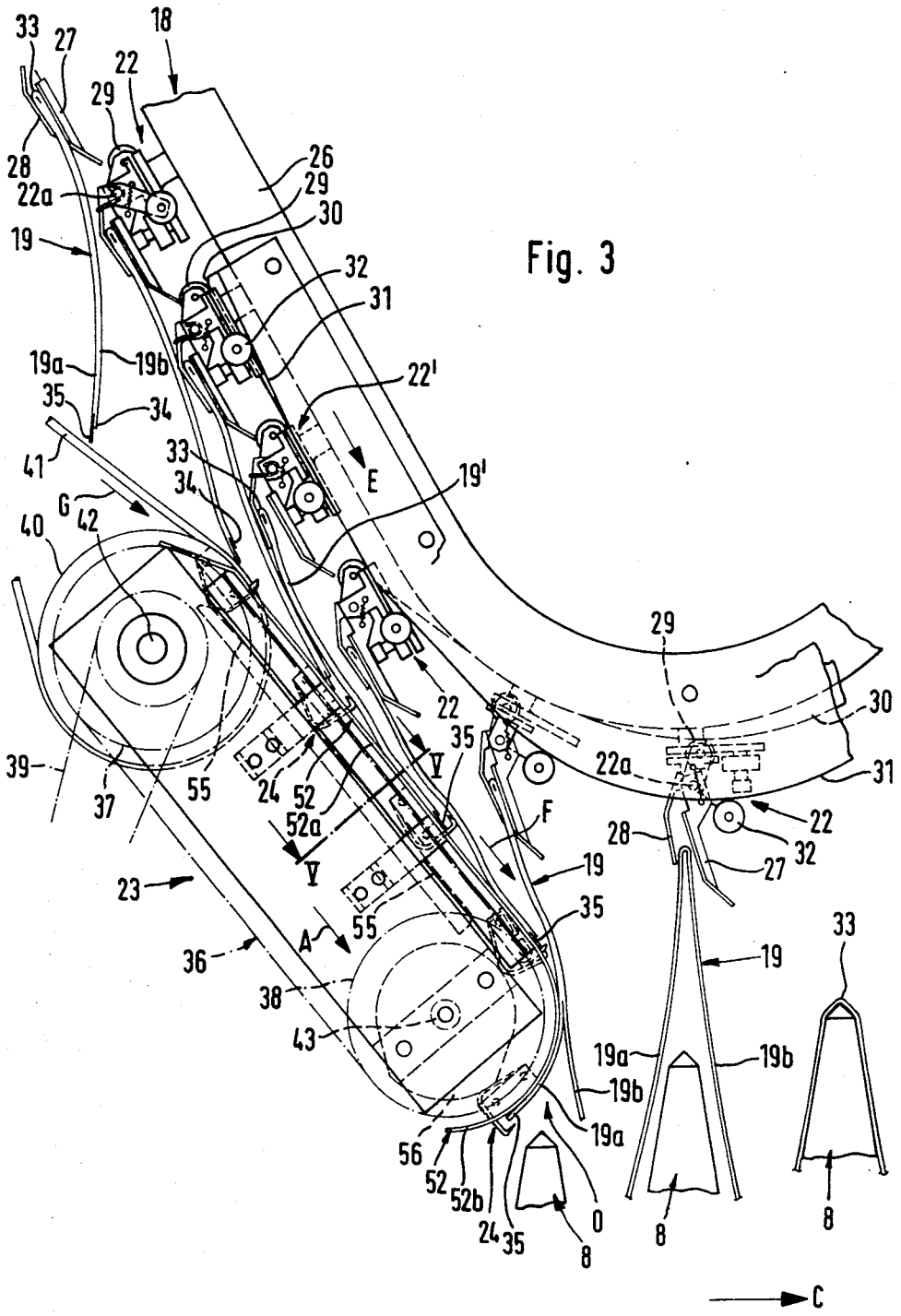
FIG. 3 is an end view on an enlarged scale and in partial section of an opening or separating device and a portion of a conveyor or feeder or feeding device used in the collating installation of FIG. 2.

As shown in FIG. 3, the grippers or clamps 22 of the feeders or feeding devices 18 are fastened to a traction or tension member, such as a chain, which is circulatingly driven and guided in a channel 26. This traction or tension member is of conventional design and therefore will not be further described here in more detail. Each clamp or gripper 22 comprises an upper clamping jaw 27 and a lower movable clamping jaw 28. The grippers or clamps 22 are pivotably positioned about a pivot axis designated by the reference numeral 22a. These grippers or clamps 22 comprise a guide or control roll or follower 29 which cooperates with a guide or control curve or cam 30 which is positioned on a side of the channel 26. The purpose of the control curve or cam 30 is to hold the clamps 22 in the desired pivotable position. On the other side of the channel 26 there is located a further guide or control curve or cam 31. This control curve or cam 31 cooperates with a further guide or control roll or follower 32 which is connected with the movable clamping jaw 28. A swinging or pivoting of the movable clamping jaw 28 out or away from the upper clamping jaw 27 into a free or released position is achievable by means of the control roll or follower 32 which rides on the control curve or cam 31. The movable clamping jaw 28 is locked or held in its locking or clamping position by any suitable means, e.g. by means of a torsion spring. The movable clamping jaw 28 together with the upper clamping jaw 27 holds or grips the printed products 19 at their folded or spine edge or backbone 33. The grippers or clamps 22 are forwardly directed in the direction of conveyance E of the related feeder or feeding device 18, i.e. these clamps 22 comprise an open jaw which opens towards the direction of conveyance E. The printed products 19 are thus fed or conveyed towards the associated opening device 23 with their open or fan edges 34, which are located opposite to the folded or spine edges 33, leading. The printed products 19 are folded off-center or asymmetrically, which means that one portion or section 19a of the aforesaid open edge 34 marginally overlaps or protrudes beyond the other portion or section 19b of the printed product 19. The leading edge region of the portion or section 19a of the printed product 19, which is termed the marginal lap, is designated by the reference numeral 35.

The direction of conveyance or feed E of each feeder or feeding device 18 is downwardly and obliquely directed in the region of the related opening device 23 (as is illustrated in FIG. 3). The conveyed or supplied printed products 19 likewise assume a downwardly and obliquely directed position as seen in the direction of conveyance E. According to the embodiment shown in FIG. 3 the printed products 19 are fed such that the portion or section 19a of the printed product 19 possessing the leading marginal lap 35 is located on the lower side or underside.

The holding members i.e. the holding clamps or grippers 24 of each of the opening device 23 are attached at regular or uniform distances or spacings to an associated circulatingly or revolvingly driven chain 36. The construction of these holding clamps 24 will be described hereinbelow in relation to FIGS. 3 to 8. The chain 36 is guided over two sprockets or sprocket wheels 37 and 38. The sprocket or sprocket wheel 37 is driven such that the chain 36 together with the holding clamps or grippers 24 rotates or circulates in the direction of the arrow F (cf. FIG. 3). A drive chain 39 is only schematically shown as a drive means for the sprocket or sprocket wheel 37. Co-rotating with the sprocket or sprocket wheel 37 and connected thereto is a guide wheel 40. A round endless belt 41 is trained about this guide wheel 40. Not illustrated in FIG. 3 is the other guide wheel for the round endless belt 41. The direction of rotation of the endless belt 41 is designated by reference character G. The printed products 19 fed or supplied by means of the feeders or feeding devices 18 arrive with their open edge 34 resting on the upper run of the associated round endless belt 41 of the related opening device 23. The printed products 19 are thereby brought into the correct position to be later gripped or retained by the holding clamps 24.

Figure 5:
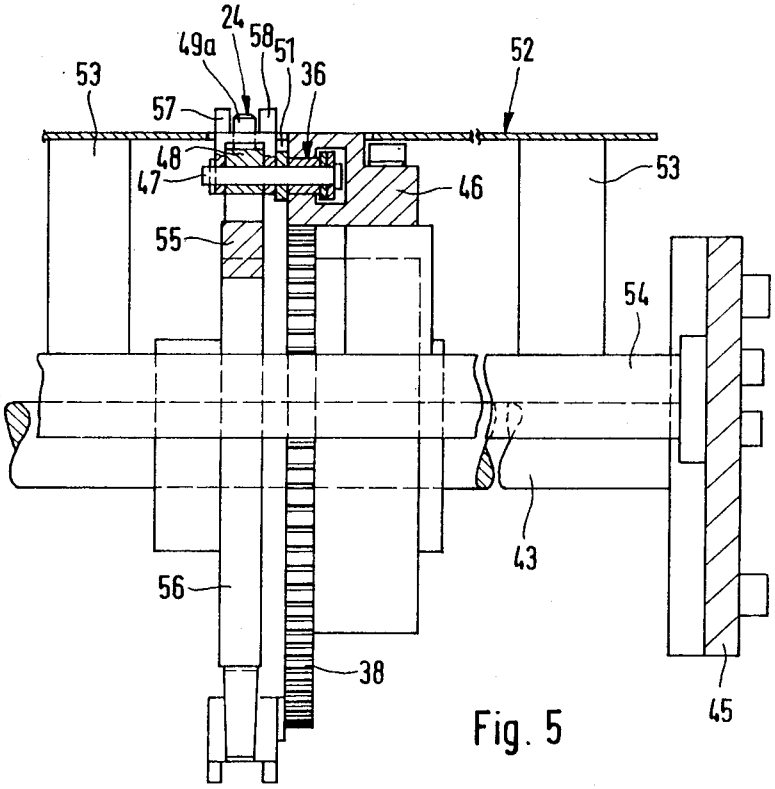
FIG. 5 is a partial section on an enlarged scale of the opening or separating device taken along the line V—V in FIG. 3.
Figure 4:
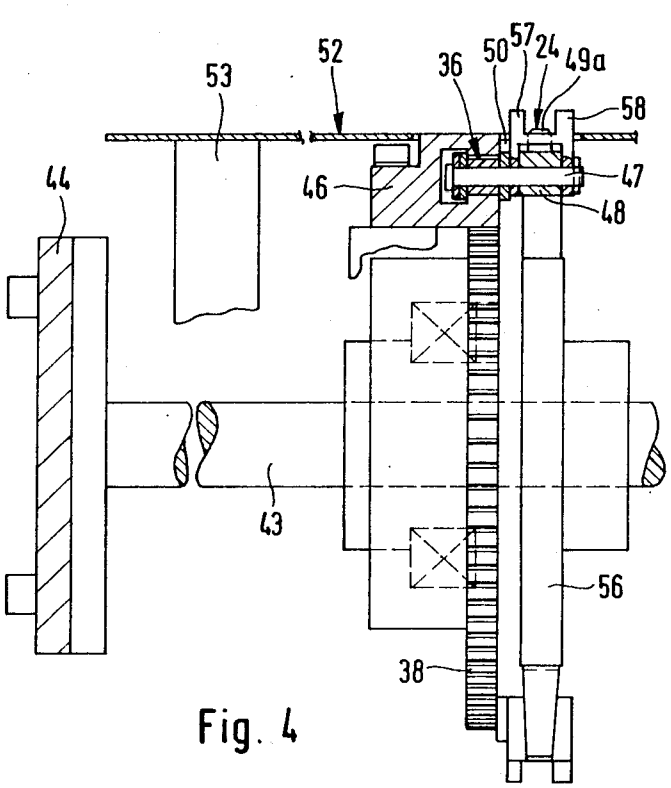
FIG. 4 is a view on an enlarged scale and in partial section of the opening or separating device according to FIG. 3 taken in the direction of the arrow A thereof.

As can be seen from FIGS. 4 and 5, only the respective left and right halves of one of the opening devices 23 are illustrated. In these two FIGS. 4 and 5, two chains 36 which are mutually separated by a predetermined spacing and are substantially parallel to one another, are provided with holding grippers or clamps 24 attached to these chains 36. Accordingly, two sprockets or sprocket wheels 37 and 38, respectively, are provided which are located on the respective shafts 42 and 43 (cf. FIG. 3). These shafts 42 and 43 are rotationally positioned in respective lateral support plates or panels 44 and 45 (cf. FIGS. 4 and 5). The chains 36 are guided in guides or guide members 46 as can especially seen in FIGS. 4 and 5.

Figure 6:
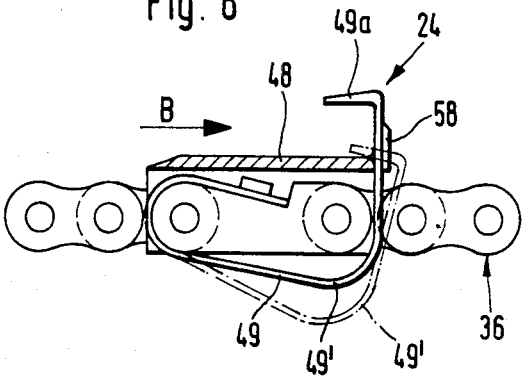
FIG. 6 is a side view and partial section of a holding member or element of the opening or separating device shown in FIGS. 3–5 and on an enlarged scale.
Figure 7:
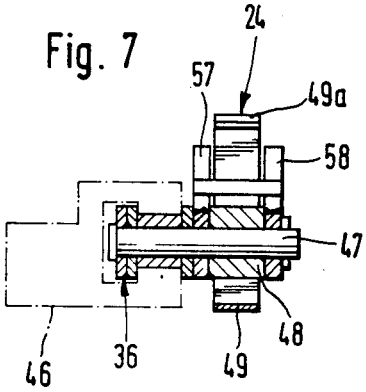
FIG. 7 is a front view in partial section of the holding member or element of the opening device and viewed in the direction of the arrow B according to FIG. 6.
Figure 8:
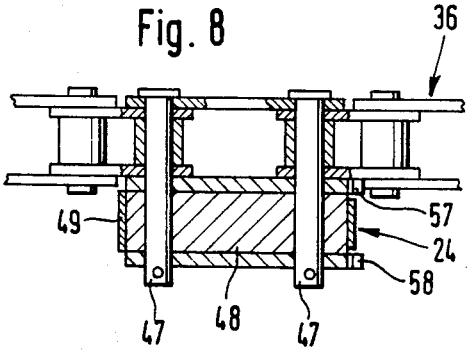
FIG. 8 is a top plan view in partial section of the holding member or element according to FIG. 6.

Fastening bolts 47 are fastened to the chains 35 and protrude laterally therefrom. A holder or support 48 for the holding grippers or clamps 24 is mounted on these fastening bolts 47 (cf. especially FIGS. 7 and 8). The holding grippers or clamps 24 are formed by means of a bent resilient or spring element 49 fastened to an end of the support 48. At the other end of the support 48 this resilient or spring element 49 is skewed or bent into a gripping or clamping finger 49a as can be seen from FIG. 6. The resilient or spring element 49 is shown in dotted and dashed lines in FIG. 6 in its lower relaxed or clamping position which it automatically assumes as a result of its resilient elasticity. From this lower relaxed position the resilient element 49 can be moved in a manner yet to be described into an upper open or product releasing position as is illustrated in FIG. 6 with solid lines.

The holding grippers clamps 24 extend through longitudinal slots 50 and 51 in a support plate or panel 52 (cf. FIGS. 4 and 5). This support panel 52 comprises a substantially straight section 52a and an adjacent bent or curved section 52b as seen in the direction of motion F of the holding clamps 24. This bent or curved section 52b is spaced at a predetermined distance from the sprocket or sprocket wheel 38 and substantially follows its path of curvature as is shown in FIG. 3. The support panel 52 is supported by means of supports or holders 53 which are attached to a cross member 54. This cross member 54 extends between side panels 44 and 45 (cf. FIGS. 4 and 5). The substantially straight section 52a of the support panel 52 is downwardly bent as seen in the direction of movement F of the holding clamps 24. This substantially straight section 52a therefore extends in substantially the same direction as the region of the path of movement of the grippers or clamps 22 lying above the opening device 23.

Below the substantially straight section 52*a* of the support panel 52 there is positioned a control or guide curve or cam 55 upon which travel the holding clamps or grippers 24 with a support or contact surface 49' (cf. FIG. 6) of the resilient elements 49. This guide curve or cam 55 elevates the resilient elements 49 out of the lower relaxed or clamping position into the upper product releasing position. A stationary control or guide cam 56 is provided adjacent to the sprocket or sprocket wheel 38. This guide cam 56 serves in the same manner as the control or guide curve or cam 55 for raising or elevating the resilient elements 49 out of the lower clamping position into the upper product releasing position.

Two stop elements or dogs 57 and 58 are positioned on both sides of each resilient element 49. These stop elements or dogs 57 and 58 are fastened to the holder or support 48. The printed products 19 come to rest on these stop elements or dogs 57 and 58 with their leading edges 34 in a manner yet to be described.

The opening of the printed products 19 supplied by the feeders or feeding devices 18 by means of the opening devices 23 is described hereinbelow.

The printed products 19 are held on their folded edge 33 by means of the grippers or clamps 22 and come to rest with their leading edges 34 on the associated circulating round belt 41. The printed products 19 are thereby brought into a skewed or forwardly descending oblique position (cf. FIG. 3). The printed products 19 travel from the round belt 41 to the substantially straight section 52*a* of the associated support panel 52. The printed products 19 thus come to rest with their leading marginal lap 35 of the lowermost portion or section 19*a* onto the substantially straight section 52*a* of the support panel 52. The circulatingly driven holding clamps or grippers 24 slightly lead the leading edges 34 of the printed products 19 as seen in the direction of the arrow F, as is illustrated in FIG. 3.

When the resilient elements 49 come into contact with the control curve or cam 55 the resilient elements 49 are moved out of the lower relaxed position into the upper product releasing position which thus prepares them for receiving the leading marginal lap 35 of the lower portion 19*a* of the printed products 19. In order now to bring this leading marginal lap 35 reliably into the effective region of the clamping finger 49*a* of the resilient elements 49, the clamps or grippers 22 of the related feeder or feeding device 18 are temporarily or momentarily opened as is shown in FIG. 3 by means of the clamp designated by the reference numeral 22'. The lifting or elevation of the movable clamping jaw 28 away from the upper clamping jaw 27 is caused by means of contact of the guide roll 32 with the guide curve or cam 31. A pivoting of each of the clamps 22 about their related pivot axis 22*a* is prevented or hindered in that the guide roll 29 is supported or braces itself on the associated guide curve or cam 30.

The printed product 19' released by means of the temporary or momentary opening of the associated clamp 22' slides downwardly into the open holding clamp or gripper 24 and stops or comes to rest with the edge of the leading marginal lap 35 on the resilient element 49 or on the stop elements or dogs 57 and 58. Now the clamp 22 is again returned into its clamping position which results in the printed product 19 again being held or clamped at its folded edge 33. Now the holding clamp or gripper 24 moves outside the effective region of the control or guide curve or cam 55. The resilient elements 49 associated therewith now move downwardly as a result of their resilient elasticity into the clamping position and thereby hold or clamp the forward or leading marginal lap 35. The holding clamps 24 together with the gripped marginal lap 35 now enter the guide region or into the region of the bent or curved section 52*b* of the support panel 52 defined by means of the sprocket or sprocket wheel 38. The clamped leading marginal lap 35 as well as its adjacent region of the lower portion or section 19*a* of the printed product 19 is now guided along the bent or curved section 52*b* of the support panel 52. Simultaneously the printed product 19 which is held as before by means of the clamp or gripper 22 is moved further by means of the associated feeder or feeding device 18. This results in the gripped lower product portion or section 19*a* being moved away from the other upper product portion or section 19*b* and is thereby separated therefrom. A circulatingly driven collating conveyor 8, as already described, now moves into a product opening 0 which has been formed thereby as is shown in FIG. 3. The held or gripped marginal lap 35 can now be released. This occurs in that contact surfaces 49' or the resilient elements 49 now come into contact with the control or guide cam 56 and are moved from the clamping position into the product release position.

The displacement path or path of movement of the clamps or grippers 22 is formed such that the opened printed products 19 now assume a suspended position in which both portions or sections 19*a* and 19*b* pass on different sides of the associated collating conveyor 8. Each clamp or gripper 22 is now opened by means of the control curve cam 31. The momentarily released printed product 19 falls in a straddling manner onto the collating conveyor 8 which has arrived between both product portions 19*a* and 19*b*. The printed products 19 which come to rest on the collating conveyors 8 are forwardly displaced or advanced in the longitudinal direction of conveyance D of the associated collating conveyor 8 to the region below the next subsequent opening device 23, as already described in relation to FIGS. 1 and 2. At this location a further respective printed product 20 or 21, as the case may be, which has been opened in the manner described above, is placed on the respective printed products 19, or 19 and 20, as the case may be, which already lie or rest on the related collating conveyor 8.

Each opening device 23 already described can also be utilized in a substantially unmodified state for opening printed products 19 by feeding or conveying the portion or section 19*a* of the printed product 19 possessing the leading marginal lap 35 on the top or upper side rather than on the lower or underlying side as described above. This will now be briefly described in relation to FIG. 9. Only basically the slightly different structure and functional differences will be treated with respect to the opening procedure described in relation to FIG. 3.

Figure 9:
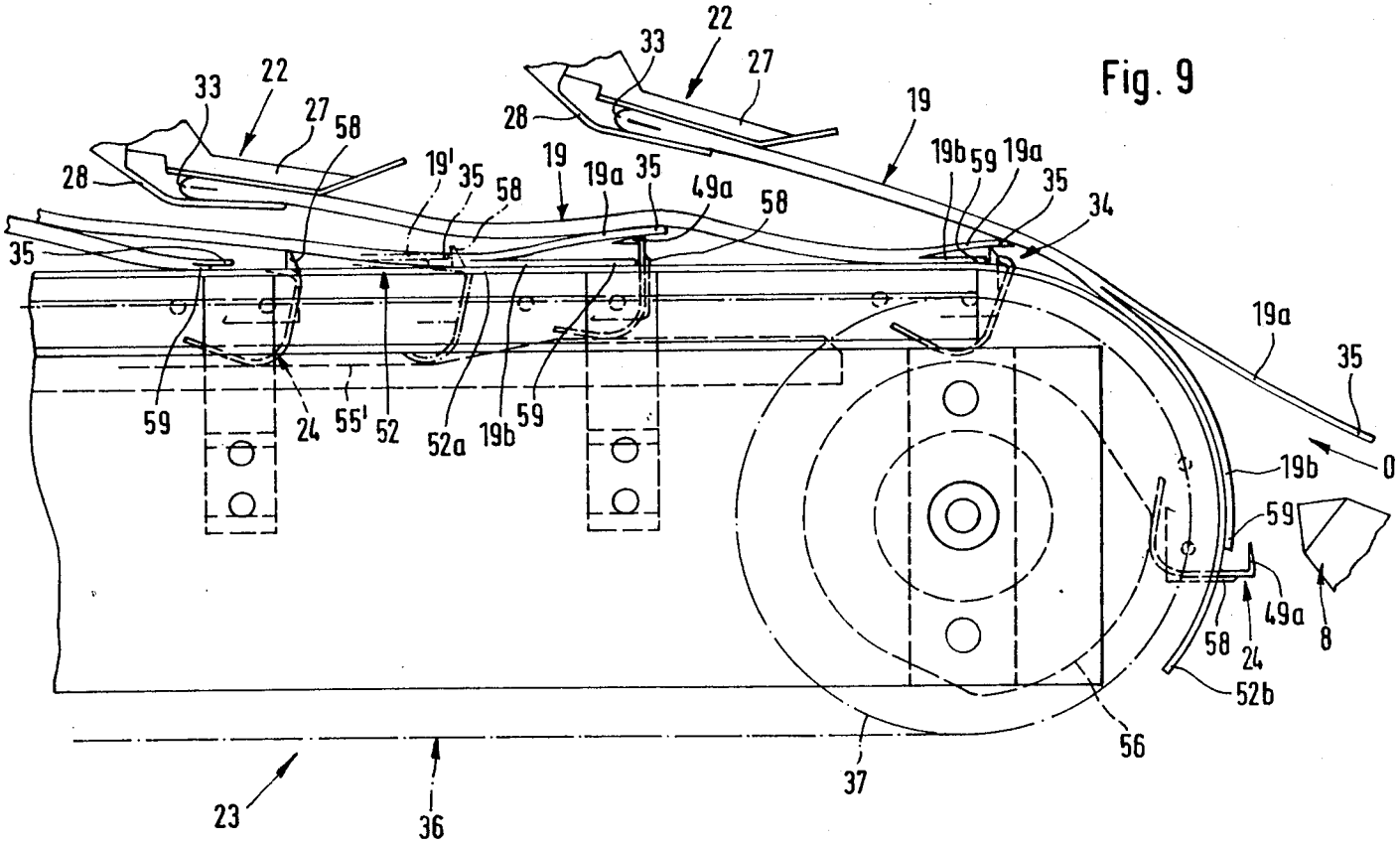
FIG. 9 is a side view, analogous to the showing of FIG. 3, on an enlarged scale and in partial section of another embodiment of the opening or separating device.

In FIG. 9 the guide curve 55' for raising or elevating the holding elements or members, namely the resilient elements or clamps 49 into their product releasing position is formed somewhat differently than the guide curve or cam 55 according to FIG. 3. These resilient elements or clamps 49 are namely held longer in their lower relaxed positions than in the embodiment according to FIG. 3 and then are first raised or elevated into the product release position after the upper portion or section 19*a* of the printed product 19 has stopped with its leading marginal lap 35 against the stop elements or dogs 57 and 58. This is shown in dotted and dashed lines indicating the printed product 19' in FIG. 9. If now the fed or conveyed printed product 19 rests against the stop elements or dogs 57 and 58 with the leading marginal lap 35, then the upper portion or section 19*a* of the printed product 19 is so raised or elevated in the region of the marginal lap or marginal lap section 35 by virtue of the raising of the resilient element 49. The printed product 19 is advanced against the associated resilient element 49 due to the temporary or momentary opening of the clamps or grippers 22 until an edge region 59 of the undermost and shorter product section or portion 19*b* of the printed product 19 arrives at the effective region of the clamping finger 49*a*. In other words, the printed product 19 is moved forward or advanced until this edge region 59 comes into contact with the resilient elements or clamps 49 or with the respective stop elements or dogs 57 and 58. As soon as the resilient elements or clamps 49 leave the control or guide curve or cam 55' they move automatically into their clamping position, in which the clamping finger 49*a* holds the undermost product portion or section 19*b* in the edge region 59 of the leading or marginal lap edge 34. The product portion or section 19*b* which is held is now moved as previously described along the bent or curved section 52*b* of the support panel 52 and is separated from the other product portion cr section 19*a*. A collating conveyor 8 can now move into the product opening 0 thus formed.

The stop elements or dogs 57 and 58 are necessary for opening the conveyed printed products 19 which have their longer portion or section 19*a* on the top as was described in relation to FIG. 9. These stop elements or dogs 57 and 58 can, under certain circumstances, be dispensed with or eliminated in the embodiment according to FIG. 3, since the resilient elements or clamps 49 also serve as a stop for the undermost product longer portion or section 19*a*.

In lieu of the revolving and circulatingly driven collating conveyors 8 as described in relation to FIGS. 1 and 2, it is also possible to only use an individual or single stationarily-located collating conveyor 8, i.e. a collating conveyor which does not revolve about a collating drum or cylinder or other member, upon which the printed products 19, 20 and 21 are deposited in the manner described. This single collating conveyor 8 can, for example, be in the form of a collating chain of conventional construction.

Furthermore, it is possible to equip the opening devices 23 according to FIG. 3 in addition to the guide curve or cam 55 with a guide curve or cam 55' which is illustrated in the embodiment shown in FIG. 9. By means of suitable changeover or selector means, the one or the other respective guide curve or cam 55 or 55' is then brought into the effective or active position in which it cooperates with the resilient elements or clamps 49 depending on the type of feed for the printed products 19. It is possible with such an embodiment to open printed products 19 which are fed either with the product portion or section 19*a* comprising the leading marginal lap 35 being on the upper or on the lower side of the printed product 19.

The delivered printed products 19, 20 and 21 can be individual folded printed sheets or signatures or can comprise a plurality of interstuffed folded printed products.

While there are shown and described present preferred embodiments of the invention, it is to be distinctly understood that the invention is not limited thereto, but may be otherwise variously embodied and practiced within the scope of the following claims.

Accordingly, what we claim is:

1. A method for opening asymmetrically folded printed products, comprising the steps of:

gripping each printed product of the asymmetrically folded printed products at a folded edge thereof;

each said printed product possessing a first portion comprising an open edge located opposite said folded edge;

conveying the asymmetrically folded printed products in a direction transverse to said folded edges and with said open edges leading;

momentarily holding said first portion containing said open edge of each said printed product during conveyance of each said printed product at the region of said open edge for separating said first portion from a second portion of each said printed product; and displacing said momentarily held region of said first portion of each said printed product away from said second portion for thus opening each said printed product.

2. The method as defined in claim 1, wherein:

said step of displacing said momentarily held region entails deflectingly guiding said momentarily held region of said first portion of each said printed product.

3. The method as defined in claim 1, wherein:

said step of momentarily holding said first portion entails holding a lowermost portion of each said printed product.

4. The method as defined in claim 1, further including the steps of:

releasing the asymmetrically folded printed products after opening for depositing each said printed product upon a collating device located between said first portion and said second portion of each said printed product; and conveying the asymmetrically folded printed products along said collating device in a direction extending substantially parallel to said folded edges.

5. The method as defined in claim 1, wherein:

said first portion of each said printed product which is momentarily held comprises a marginal lap protruding beyond said second portion.

6. The method as defined in claim 1, wherein:

said second portion of each said printed product comprises a marginal lap protruding beyond said first portion which is momentarily held.

7. A method for opening asymmetrically folded printed products, comprising the steps of:

gripping each printed product of the asymmetrically folded printed products at a folded edge thereof;

each said printed product possessing a first portion comprising a leading marginal lap and an open edge located opposite said folded edge;

conveying the asymmetrically folded printed products in a direction transverse to said folded edges and with said open edges leading;

momentarily holding said first portion containing said open edge of each said printed product during conveyance of each said printed product at the region of said open edge for separating said first portion from a second portion of each said printed product; and displacing said momentarily held region of said first portion of each said printed product away from said second portion for thus opening each said printed product.

8. The method as defined in claim 7, further including the steps of:

releasing the asymmetrically folded printed products after opening for depositing each said printed product upon a collating device located between said first portion and said second portion of each said printed product; and conveying the asymmetrically folded printed products along said collating device in a direction extending substantially parallel to said folded edges.

9. An apparatus for opening asymmetrically folded printed products comprising:

at least one feeder;

each printed product of the asymmetrically folded printed products possessing a leading marginal lap and an open edge thereof located opposite a folded edge thereof;

said feeder comprising gripper elements arranged in mutual spaced relationship for gripping each said printed product at said folded edge thereof;

an opening device positioned below said at least one feeder;

holding members;

means for circulatingly driving said holding members in a path of movement;

means for controlling said holding members for momentarily holding a first portion of each said printed product in the region of said open edge thereof;

said at least one feeder being arranged for conveying the asymmetrically folded printed products into the region of said opening device with said open edge of each said printed product leading; and said path of movement of said holding members being configured such that the held region of said first portion of each said printed product is displaceable away from a second portion of each said printed product.

10. The apparatus as defined in claim 9, wherein:

said path of movement of said holding members possesses a substantially straight first section;

said gripper elements having a path of conveyance;

said path of conveyance of said gripper elements having a portion situated above said substantially straight first section of said path of movement of said holding members;

said substantially straight first section extending in a first direction;

said path of conveyance extending in a second direction;

said first and second directions being substantially identical;

said path of movement of said holding members possessing a downwardly curved second section;

said holding members comprising operable holding members respectively assuming a closed state and an open state and serving for holding each said printed product in said closed state and for releasing each said printed product in said open state; and a control mechanism positioned in the region of said downwardly curved second section for opening said operable holding members.

11. The apparatus as defined in claim 10, further including:

at least two sprocket wheels;

a circulatingly drivable traction member guided over said at least two sprocket wheels;

said holding members being fastened to said traction member in predetermined mutual spaced relationship; and said control mechanism being located in the region of one of said at least two sprocket wheels.

12. The apparatus as defined in claim 10, further including:

a supporting panel extending at least along said first section of said path of movement of said holding members for supporting said leading open edges of the asymmetrically folded printed products.

13. The apparatus as defined in claim 9, wherein:

each holding member of said holding members has a lower product holding position and an upper product releasing position; and each said holding member being operable between said lower product holding position thereof and said upper product releasing position thereof.

14. The apparatus as defined in claim 13, further including:

control means for placing said holding members in said upper product releasing position thereof for receiving said leading marginal lap during conveyance of the asymmetrically folded printed products with said leading marginal lap engaging said holding members; and control means for placing said holding members into said lower product holding position thereof.

15. The apparatus as defined in claim 13, further including:

control means for moving said holding members from said product holding position thereof into said upper product releasing position thereof for elevating that portion of each said printed product provided with said leading marginal lap;

each holding member of said holding members having an effective region; and control means for moving said holding members out of said upper product releasing position into said lower product holding position after introduction of a lowermost portion of each said printed product into said effective region of each said holding member.

16. The apparatus as defined in claim 13, further including:

control members;

said holding members being formed as clamping fingers held by means of a resilient force in said lower product holding position; and said clamping fingers being elevatable by means of said control members against said resilient force into said upper product releasing position.

17. The apparatus as defined in claim 13, wherein:

said holding members being formed as clamping fingers held by means of a resilient force in said lower product holding position;

said clamping fingers being elevatable by means of said control members against said resilient force into said upper product releasing position; and said control members comprise cam means.

18. The apparatus as defined in claim 13, wherein:

said holding members being formed as clamping fingers held by means of a resilient force in said lower product holding position;

said clamping fingers being elevatable by means of said control members against said resilient force into said upper product releasing position; and said holding members are formed as resilient elements.

19. The apparatus as defined in claim 13, further including:

control means for momentarily opening said holding members before said control means move said holding members from said upper product releasing position into said lower product holding position.

20. The apparatus as defined in claim 9, further including:

circulatingly drivable stop elements arranged in said effective region of each said holding member for traveling with each said holding member and for effectively stopping said leading edges of the asymmetrically folded printed products in said effective region of each said holding member.

21. The apparatus as defined in claim 9, wherein:

said at least one feeder has a direction of conveyance;

said holding members having a direction of movement; and said direction of conveyance of said at least one feeder and said direction of movement of said holding members both extending obliquely and downwardly in the region of said opening device.

22. A collating installation for collating asymmetrically folded printed products possessing at least two opening apparatuses arranged in succession in a direction of conveyance, comprising:

at least one collating conveyor capable of being inserted between initially separated uppermost and lowermost portions of the asymmetrically folded printed products;

each opening apparatus of the at least two opening apparatuses having at least one feeder comprising gripper elements for gripping each said printed product at a folded edge thereof;

each opening apparatus further comprising an opening device positioned below each said at least one feeder;

circulatingly driven holding members provided for the opening device and means for controlling said holding members for momentarily holding a first portion of open edges of the asymmetrically folded printed products;

means for opening said gripper elements such that the asymmetrically folded printed products are released and come to rest in a straddling manner on said at least one collating conveyor; and means for transporting the asymmetrically folded printed products away from said at least two opening apparatuses in a direction extending substantially parallel to folded edges of the asymmetrically printed products.

23. The collating installation as defined in claim 22, wherein:

said at least one collating conveyor comprises a plurality of collating conveyors extending substantially parallel to the direction of conveyance;

said plurality of collating conveyors being arranged in substantially parallel spaced relationship about a common axis of revolution extending substantially parallel to the direction of conveyance;

means for circulatingly driving each said collating conveyor for conveying the asymmetrically folded printed products in the direction of conveyance; and means for revolvingly driving said plurality of collating conveyors about said common axis of revolution during conveying of the asymmetrically folded printed products.

24. The collating installation as defined in claim 23, further including:

means for rotatingly driving said plurality of collating conveyors about respective axes of rotation thereof.

* * * * *

UNITED STATES PATENT AND TRADEMARK OFFICE

CERTIFICATE OF CORRECTION

PATENT NO. : 4,684,117

DATED : August 4, 1987

INVENTOR(S) : WERNER HONEGGER et al

It is certified that error appears in the above-identified patent and that said Letters Patent is hereby corrected as shown below:

Column 3, line 38, after "leading" please insert --and displacing the gripped region of the first portion or--

Column 3, line 39, after "portion" please insert --or--

Signed and Sealed this

Fifth Day of April, 1988

*Attest:*

*Attesting Officer*

DONALD J. QUIGG

*Commissioner of Patents and Trademarks*